United States Patent [19]

Simms

[11] Patent Number: 4,861,031

[45] Date of Patent: Aug. 29, 1989

[54] CARD WRESTLING GAME

[76] Inventor: Cosmian E. Simms, 5510 Fernpark Ave., Baltimore, Md. 21207

[21] Appl. No.: 182,496

[22] Filed: Apr. 18, 1988

Related U.S. Application Data

[63] Continuation-in-part of Ser. No. 66,225, Sep. 28, 1987, abandoned.

[51] Int. Cl.[4] ..... A63F 1/00; A63F 1/02; A63F 9/22

[52] U.S. Cl. ..... 273/85 G; 273/295; 273/298; 273/DIG. 28

[58] Field of Search ..... 273/295, 298, 85 G, 273/DIG. 28; 350/144

[56] References Cited

U.S. PATENT DOCUMENTS

| | | | |
|---|---|---|---|
| 1,322,954 | 11/1919 | Rosenfeld | 273/298 |
| 1,404,599 | 1/1922 | Glenny | 273/298 X |
| 1,640,261 | 8/1927 | Whaley et al. | 273/298 |
| 3,663,021 | 5/1972 | Whippo | 273/296 |
| 4,681,324 | 7/1987 | Karabed et al. | 273/295 |
| 4,728,108 | 3/1988 | Neuwahl | 273/296 |

*Primary Examiner*—Anton O. Oechsle
*Attorney, Agent, or Firm*—Leonard Bloom

[57] ABSTRACT

A competitive card wrestling game that simulates a competitive wrestling match. The game includes a plurality of images including a first portion of images representing wrestling "escape" maneuvers, a second portion of images representing wrestling "submission hold" maneuvers and a third portion of images representing wrestling "combat" maneuvers. The images may be sequentially displayed on playing cards or a video screen. Each competitor draws a plurality of images. The first competitor sequentially selects and displays three images. The second competitor sequentially selects and displays three images in response to those selected by their opponent. A "pin" occurs when the last sequentially displayed image by either competitor is a "submission hold" maneuver and the opposing competitor first sequentially displayed image in response thereto is any image other than an "escape" maneuver. Normal display sequence by either competitor will be an "escape" maneuver, a "combat" maneuver and, lastly, a "submission hold" maneuver.

9 Claims, 8 Drawing Sheets

ESCAPE

BAILOUT

FOOT
ON
ROPE

ABDOMINAL STRETCH

SUBMISSION

FIGURE-FOUR LEG-LOCK

SLEEPER HOLD

SUBMISSION

COVER AND PIN

SPINNING TOE HOLD

FULL NELSON

SUBMISSION

BOSTON CRAB

BEAR HUG

SUBMISSION

BACK BREAKER

SUBMISSION

FLYING DROP KICK

PILE DRIVER

BELLY TO BELLY SUPLEX

NECK BREAKER

CLOTHESLINE

BRAIN BUSTER

SIDE SUPLEX

BACK SUPLEX

HEAD BUTT

FLYING ELBOW

ATOMIC KNEE DROP

CROSS BODY BLOCK

CARD WRESTLING GAME

CROSS-REFERENCE TO RELATED APPLICATION

The present invention is a continuation-in-part of copending U.S. patent application Ser. No. 066,225 filed Sept. 28, 1987, abandoned, the disclosure of which is hereby incorporated in its entirety by reference herein.

BACKGROUND OF THE INVENTION

Games, including card games, which simulate "real-life" competitive sports are a widespread form of entertainment. Examples of competitive sports which have been simulated in such competitive games include soccer, basketball and baseball.

I am also aware of several games and, in particular, competitive card games which simulate the "real-life" sport of boxing. These card games, of which I am aware, are those described in United States Letters Patent Nos. 1,322,954 issued to Rosenfeld; 1,404,599 issued to Gleeny; and 1,640,261 issued to Whaley et al. However, there is no game, and in particular, no card game, of which I am aware, which simulates the "real-life" sport of wrestling.

Thus, there remains a need for a competitive game, and especially, a competitive card game which simulates the competitive sport of wrestling.

SUMMARY OF THE INVENTION

Accordingly, it is a primary object of the present invention to provide a competitive game which simulates the "real-life" sport of wrestling.

It is another object of the present invention to provide such a competitive game, that is a competitive card game, which simulates the competitive contact sport of wrestling.

It is a further object of the present invention to provide such a competitive game which realistically simulates the maneuvers and actions of "real-life" wrestling.

It is a still further object of the present invention to provide such a competitive wrestling game wherein each competitor sequentially executes an "escape" maneuver, a "combat" maneuver and, lastly, a "submission hold" maneuver, and wherein if an "escape" maneuver is not executed by a first player in response to a "submission hold" maneuver executed by a second player, then a "pin" occurs resulting in the second player winning the match.

In accordance with the teachings of the present invention, there is disclosed an apparatus for playing a competitive game that simulates a competitive wrestling match. This apparatus includes a plurality of images. This plurality of images includes a first portion of the images which represent wrestling "escape" maneuvers. A second portion of the images represent various wrestling "submission hold" maneuvers. A third portion of the images represent other wrestling "combat" maneuvers. Also, means is provided for sequentially displaying the images in a chosen sequence, whereby the wrestling match is simulated.

Preferably, the ratio of images provided in the first, second and third portions is substantially 7:9:11. In this regard, it is further preferred that fifty-four images are provided. The first portion includes fourteen of said images. The second portion includes eighteen of said images. Finally, the third portion includes twenty-two of said images.

In one embodiment, the means for sequentially displaying the images in a chosen sequence are playing cards. If desired, each of the playing cards is provided having a "shadow" effect. In this event, each of the respective playing cards is laminated with at least two respective sheets. Each respective sheet has a portion of the image thereon. The portion of the image on each respective sheet is staggered relative to the other respective sheet. In this fashion, the "shadow" effect is provided when the playing card is tilted.

Alternatively, the means for sequentially displaying said images includes a video screen for displaying the images. A reader means is provided for reading the chosen sequence of images. Means is also provided for communicating the read chosen sequence of images to the video screen, whereby the images are displayed in the sequence chosen.

In further accordance with the teachings of the present invention, a method is disclosed for playing a competitive game for two or more competitors that simulates a competitive wrestling match. This game has a plurality of images including a first portion of images representing wrestling "escape" maneuvers, a second portion of the images representing wrestling "submission hold" maneuvers, and a third portion of the images representing other wrestling "combat" maneuvers. This game also includes means for sequentially displaying the images in a chosen sequence, whereby the wrestling match is simulated. The method of playing this game includes determining the order in which the competitors are to take turns, whereby a first competitor and a second competitor are defined. Each competitor randomly draws, in turn, a first plurality of images. The first competitor then draws an additional plurality of images, whereby the first competitor has a combined plurality of images available from which to choose and display. The first competitor sequentially chooses and sequentially displays a portion of the combined plurality of the available images, such that if availavble, the last image displayed is a "submission hold" image. The second competitor then draws an additional plurality of images, whereby the second competitor has a combined plurality of available images from which to choose and display. The second competitor then sequentially chooses and sequentially displays a portion of the combined plurality of the available images. When the last image displayed by the first competitor is a "submission hold " image, the first image displayed by the second competitor is an "escape" maneuver image, if available. Also, if available, the last image subsequently displayed is a "submission hold" image. Each competitor, in turn, then randomly draws, chooses and displays an additional plurality of images.

In this process, when the last image displayed by one of the competitors is a "submission hold" maneuver, and further wherein when the first image displayed by the other competitor is a "combat" (basic) wrestling maneuver or a "submission hold " maneuver, a "pin" is defined. In this manner, the one of the competitors wins the match and the other competitor loses the match.

These and other objects of the present invention will become apparent from a reading of the following Specification, taken in conjunction with the enclosed drawings.

DESCRIPTION OF PREFERRED EMBODIMENTS

The apparatus of the present invention includes a plurality of images, each of which illustrates one of the three particular types of wrestling maneuvers which occur in "real-life" wrestling.

A first portion of the images represent various wrestling "escape" maneuvers. As referred to herein, "escape" maneuvers are those wrestling maneuvers wherein a competitor escapes from any one of a number of other particular wrestling maneuvers (and in particular, "submission hold" maneuvers) that have been executed by the other competitor. A second portion of the images represent various wrestling "submission hold" maneuvers. As referred to herein, "submission hold" maneuvers are those wrestling maneuvers wherein a competitor may be "pinned" by the opposing competitor, if in response thereto an "escape" maneuver is not executed by the competitor. Finally, a third portion of the images represent various wrestling "combat" (basic) maneuvers. As referred to herein, "combat" (basic) maneuvers are those remaining wrestling maneuvers that occur during a "real-life" wrestling match.

As in a "real-life" wrestling match, the competitors sequentially choose and execute (display) selected wrestling moves that are available to them. Also, as in a "real-life" wrestling match, the competitors go through a series of "combat" (basic) maneuvers, "submission hold" maneuvers and "escape " maneuvers. Finally, as in a "real-life" wrestling match, when one competitor places the other competitor in a "submission hold" maneuver, and the other competitor does not have an "escape" maneuver, the one competitor "pins" the other competitor, resulting in the one competitor winning the match and the other competitor losing the match.

The apparatus of the present invention further includes means for sequentially displaying the images in a chosen sequence, whereby the wrestling match is simulated.

Preferably, the means for sequentially displaying the images are a plurality of playing cards. Each of said playing cards has a respective image thereon. With reference now to FIGS. 1–6, the preferred embodiment of the playing cards is illustrated. Each of said cards 10 is provided having a front face 11 and a back face 12. The front face 11 if each of the cards 10 has the respective image 13 thereon.

If desired, these cards 10 can be the type of playing cards well known to those skilled in the art, which are fabricated from paper and wax having the image printed (positioned) on one of the faces thereof.

However, I prefer to fabricate the cards so that the image, which is positioned on one face 11 or 12 thereof, is a type of image 13 that is commonly referred to as "holographic", so that tilting or pivoting back and forth movement of the card produces the effect of movement of the images (figures).

Figure 1:
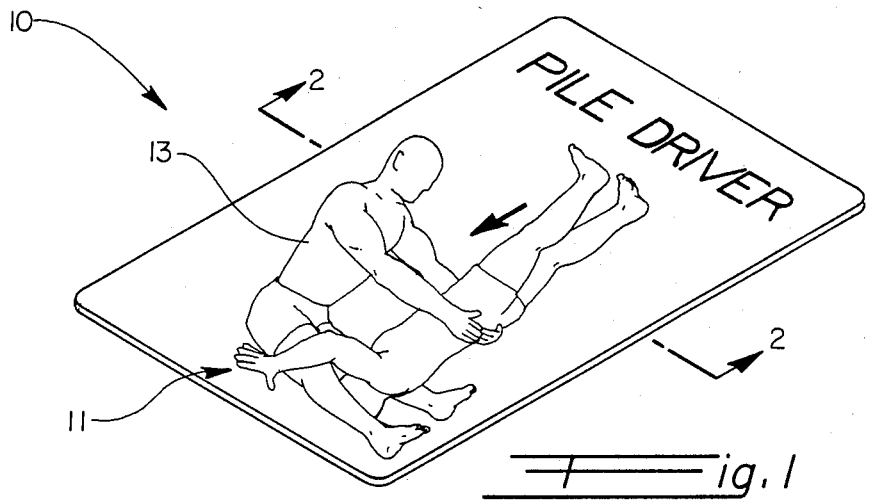
FIG. 1 is a perspective view of a playing card of the present invention.
Figure 2:
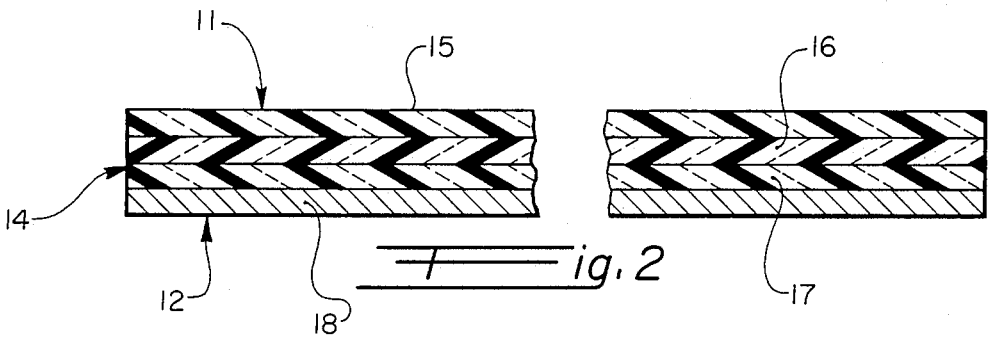
FIG. 2 is an enlarged cross-sectional view taken along lines 2—2 of FIG. 1.
Figure 3:
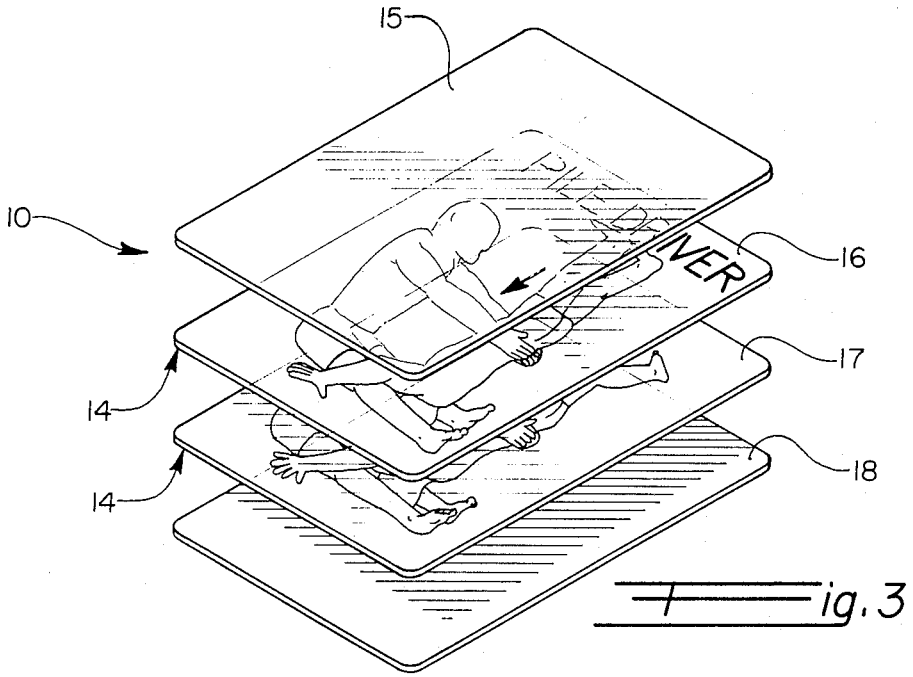
FIG. 3 is an exploded perspective view of the playing card of FIG. 1.
Figure 4:
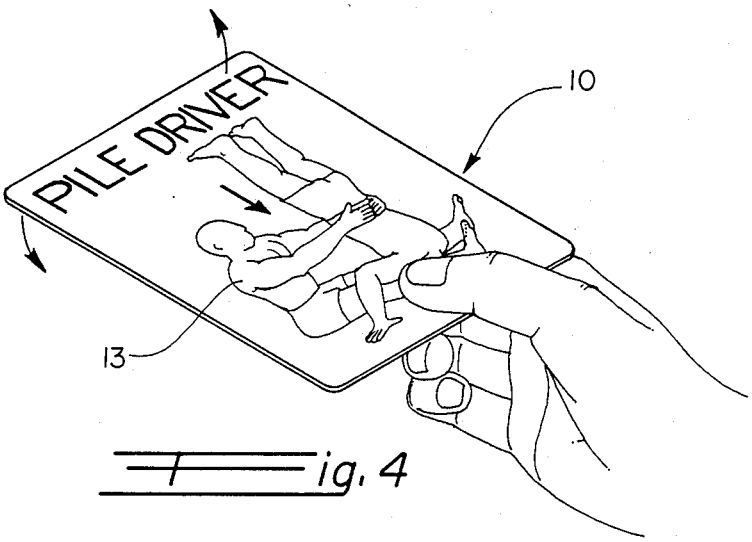
FIGS. 4–6 are respective sequence views, showing the playing card of FIG. 1 being pivoted back and forth during use to give the effect of movement of the images.
Figure 5:
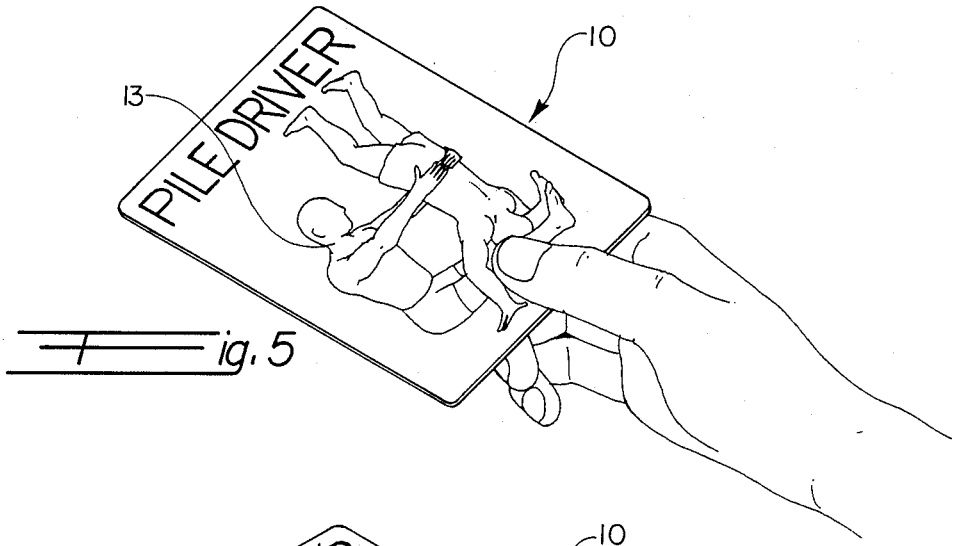
Figure 6:
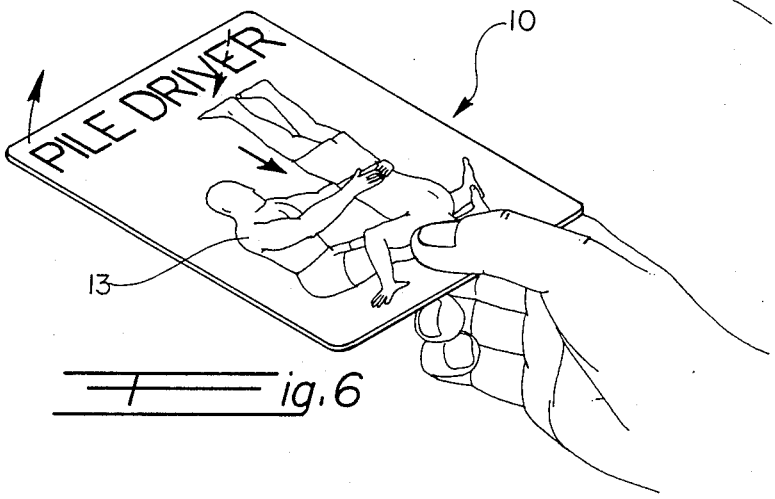

With particular reference now to FIGS. 2 and 3, each card 10 is of laminated construction. The card 10 is built up (laminated) with respective sheets (layers) 14. The sheets 14 each have an image thereon which, when the respective sheets 14 are staggered, form a portion of the overall image on, as illustrated herein, the front face 11 to provide the "shadow" movement effect when the card is tilted or pivoted.

Preferably, the first sheet (layer) 15 is a clear plastic layer. The second sheet (layer) 16 is a clear "flip-flop" printed layer. The third sheet (layer) 17 is a "flip-flop" printed layer. Finally, the fourth sheet (layer) 18) is a backing layer, wherein a backing for the card 10 is provided.

Figure 7:
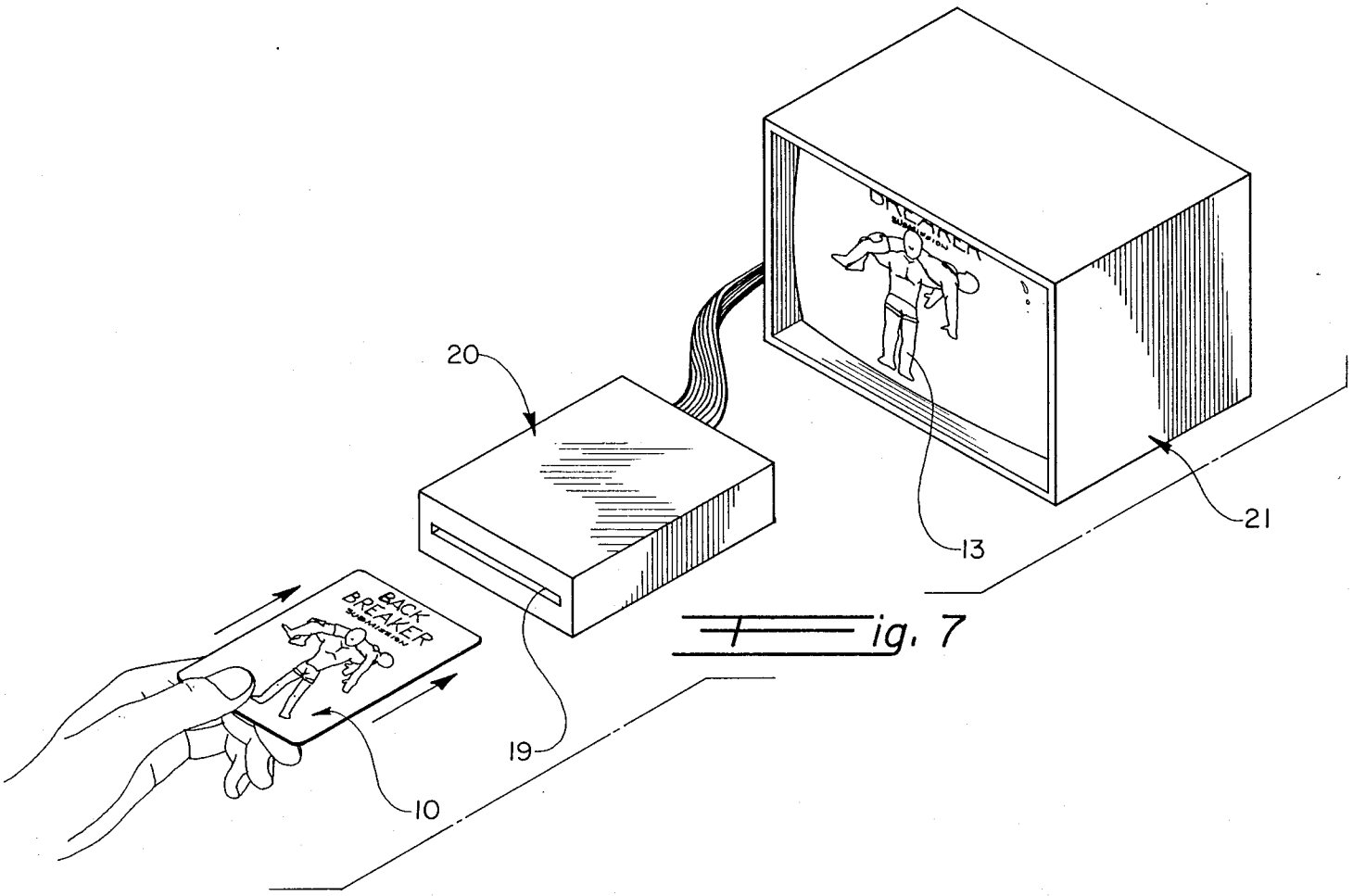
FIG. 7 is a perspective view of one means for sequentially displaying the chosen images.

With further reference now to FIG. 7, in a preferred embodiment, the means for sequentially displaying the images in a chosen sequence includes each of the cards 10, alternatively or additionally, are formed having means thereon which may be read by any suitable type of reading device 19, such as an optical or magnetic reader, well known to those skilled in the art. This reader 19 may be integrated for use with a computer (or any other suitable device capable of interpreting and translating said image) 20. In combination with a video screen 21, the maneuvers on the card 10 read by the reader 19 are communicated to the computer 20 which then displays the maneuvers on the video screen 21 in the sequence chosen. The reader 19 may be provided as a separate element or it may be integrated with the computer 20 or, as illustrated, on the video screen 21 itself.

Returning now to the images 13 themselves, preferably, the quantity of the first, second and third portions of images 13 provided are in a ratio being substantially 7:9:11. It is especially preferred for fifty-four of such images 13 to be provided. In such a case, the first portion includes fourteen images, the second portion includes eighteen images and the third portion includes twenty-two images.

Figure 8A:
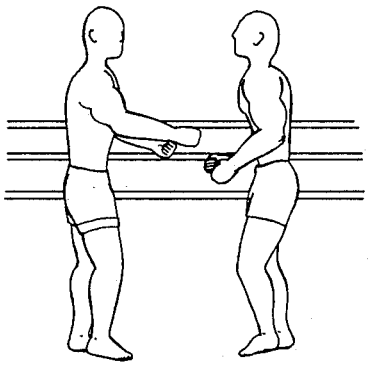
FIGS. 8A–8C illustrate the various images of wrestling "escape" maneuvers displayed.
Figure 8B:
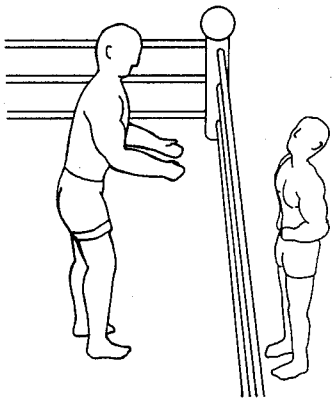
Figure 8C:
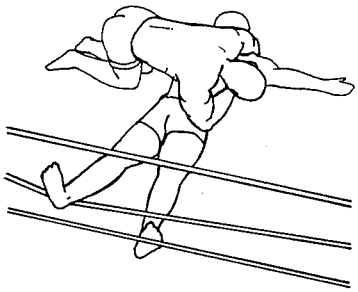

Referring now to FIGS. 8A–8C, the "escape" maneuvers displayed include the "bail out" maneuver (FIG. 8B), the "foot-on-rope" maneuver (FIG. 8C) and the "escape" maneuver (FIG. 8A). Preferably, four "bail out", four "foot-on-rope" and six "escape" maneuver images are provided. In the event that "holographic" cards, or the video screen is provided, each figure for each respective maneuver is illustrated as a single image which is displayed by tilting or pivoting of the card, giving a three dimensional "shadow" action effect.

Figure 9A:
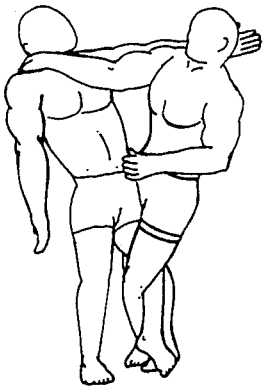
FIGS. 9A–9I illustrate the various images of wrestling "submission hold" maneuvers displayed.
Figure 9B:
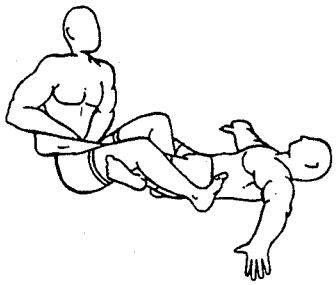
Figure 9C:
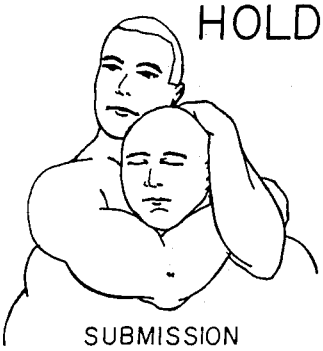
Figure 9D:
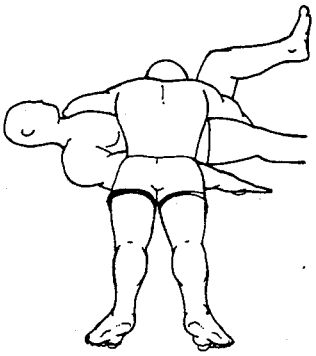
Figure 9E:
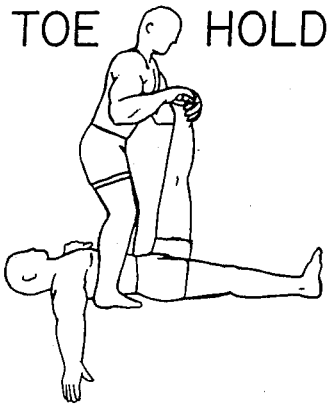
Figure 9F:
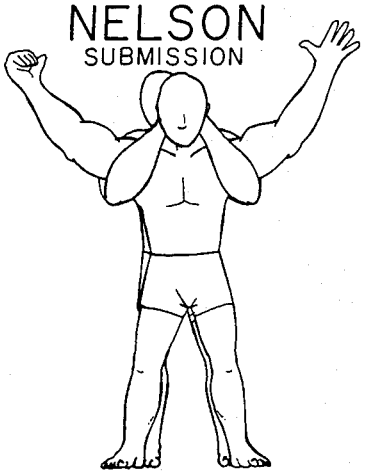
Figure 9G:
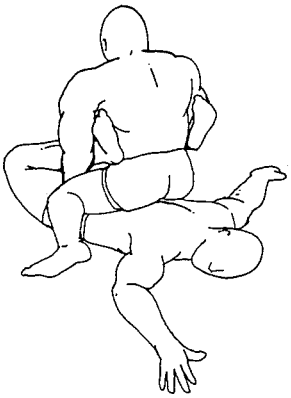
Figure 9H:
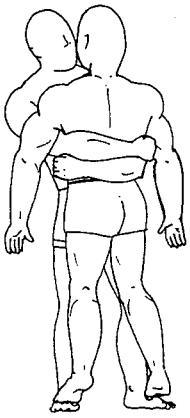
Figure 9I:
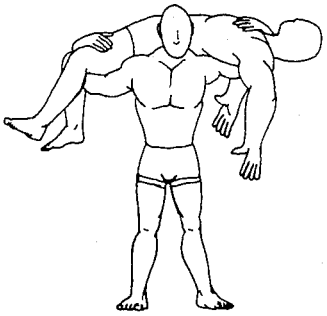

Referring now to FIGS. 9A–9I, the "submission hold" maneuvers displayed include the "sleeper hold" maneuver (FIG. 9C), the "spinning toe hold" maneuver (FIG. 9E), the "Boston crab" maneuver (FIG. 9G), the "figure four leg lock" maneuver (FIG. 9B), the "full Nelson" maneuver (FIG. 9F), the "bear hug" maneuver (FIG. 9H), the "abdominal stretch" maneuver (FIG. 9A), the "back breaker" maneuver (FIG. 9I) and the "cover and pin" maneuver (FIG. 9D). Preferably, two images of each of the nine foregoing "submission hold" maneuvers are provided. Once again, in the event that "holographic" cards, or the video screen is provided, each figure for each respective maneuver is illustrated as a single image which is displayed by tilting or pivoting of the card, giving a three dimensional "shadow" action effect.

Figure 10A:
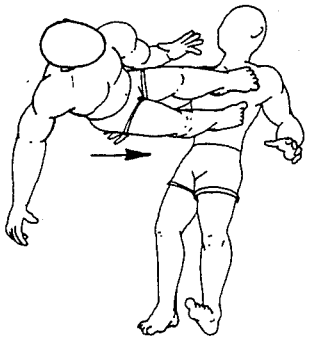
FIGS. 10A–10L illustrate the various images of wrestling "combat" (basic) maneuvers displayed.
Figure 10B:
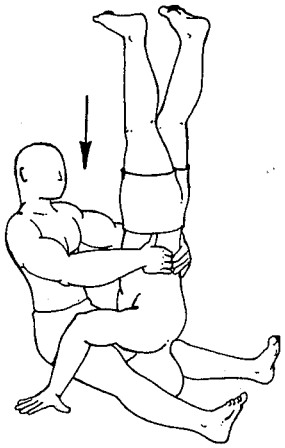
Figure 10C:
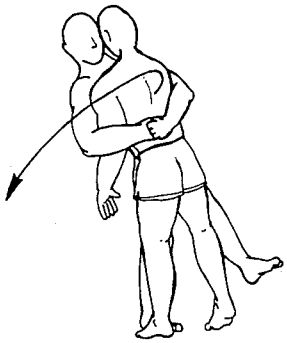
Figure 10D:
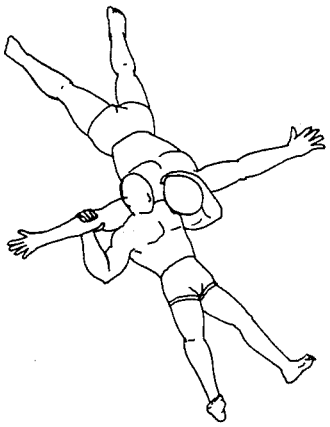
Figure 10E:
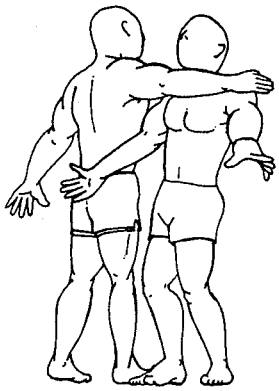
Figure 10F:
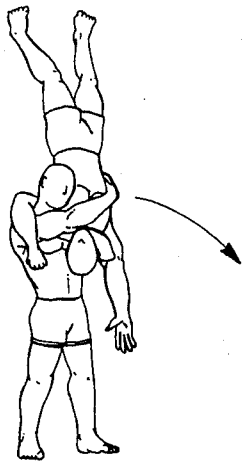
Figure 10G:
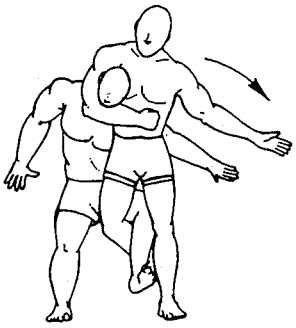
Figure 10H:
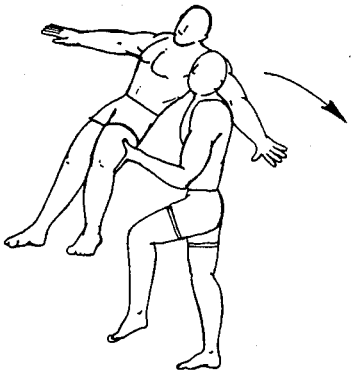
Figure 10I:
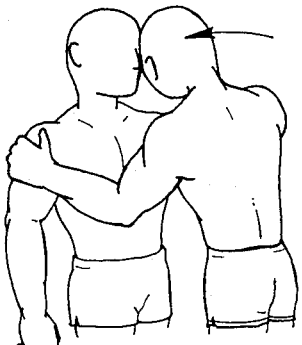
Figure 10J:
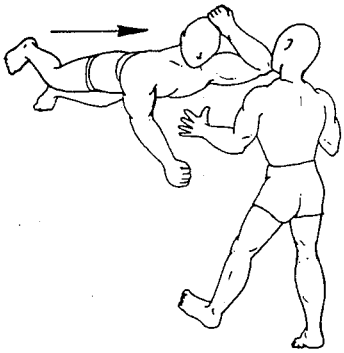
Figure 10K:
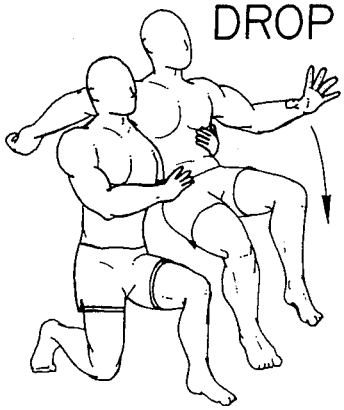
Figure 10L:
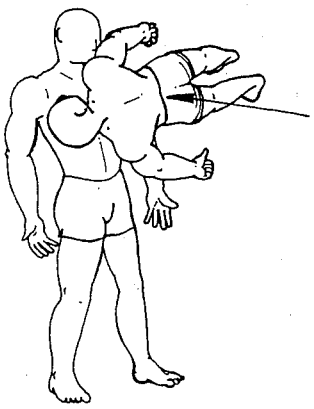

Referring now to FIGS. 10A-10L, the "combat" (basic) wrestling maneuvers displayed include the "clothes-line" maneuver (FIG. 10E), the "atomic knee drop" maneuver (FIG. 10K), the "belly-to-belly suplex" maneuver (FIG. 10C), the "back suplex" maneuver (FIG. 10H), the "flying drop kick" maneuver (FIG. 10A), the "side suplex" maneuver (FIG. 10G), the "head butt" maneuver (FIG. 10I), the "pile driver" maneuver (FIG. 10B), the "neck breaker" maneuver (FIG. 10D), the "brain buster" maneuver (FIG. 10F), the "cross-body block" maneuver (FIG. 10L), and the "flying elbow" maneuver (FIG. 10J). Preferably, two images of each of the above maneuvers is provided, except for the "cross body block" maneuver and the "flying elbow" maneuver of which only one image of each is provided. Once again, in the event that "holographic" cards or the video screen is provided, the figures for each image are incorporated as part of a single image, which is displayed by tilting or pivoting of the card giving a three dimensional "shadow" action effect.

Having thus described the apparatus of the present invention, with further reference now to FIGS. 11-14, the method of playing the competitive wrestling game is now described.

First, the competitors determine the order in which they are to take turns. This determination may be done in any suitable manner well known to those skilled in the art, such as by flipping a coin, drawing straws or by mutual agreement. In this fashion, a first competitor, who proceeds first in order, and a second competitor, who proceeds second in order, is defined.

Figure 11:
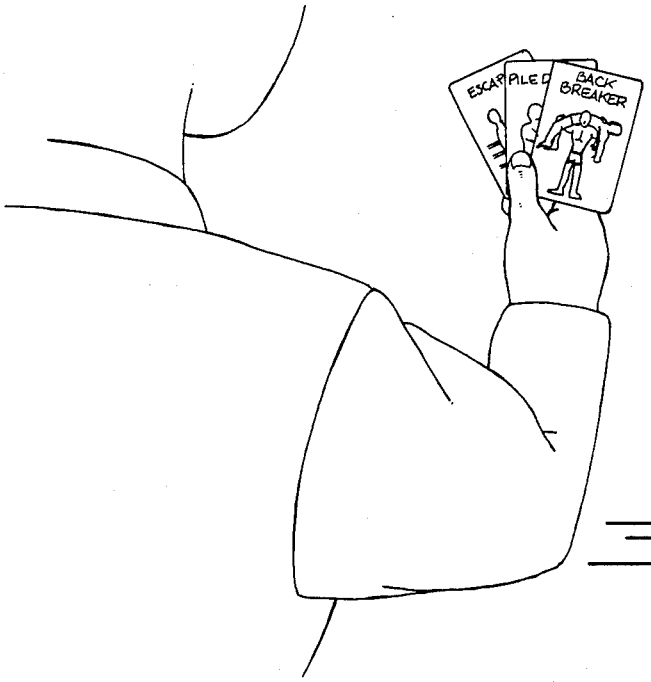
FIGS. 11–14 sequentially illustrate the method of the present invention.

Next, each competitor then, in turn, randomly draws three images from the (fifty-four) available images. The first competitor then draws an additional three images from the (forty-eight) remaining images. In this fashion, the first competitor has six images from which to choose and display during his or her turn (FIG. 11).

Next, the first competitor then chooses and sequentially displays, from the six drawn images available three images. Preferably, since this is the first turn (or hand) played in the match (game), the first competitor plays, if possible, two "combat" (basic) maneuvers, and, as the third image sequentially displayed, a "submission hold" image, if available.

Figure 12:
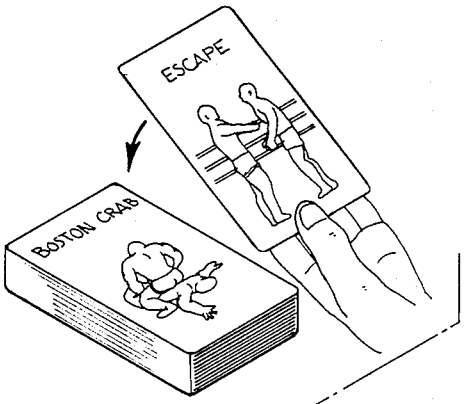
Figure 13:
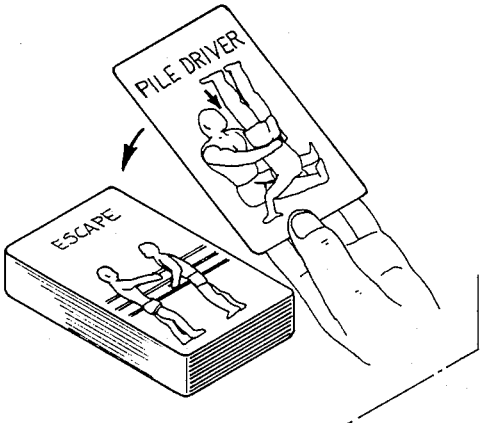

The second competitor then draws an additional three images from the (forty-five) remaining images. If the third image sequentially displayed by the first competitor is a "submission hold" image, then the second competitor must display, as the first image sequentially displayed in this turn, an "escape" maneuver image (FIG. 12). If no "escape" maneuver image is among the six drawn images available to the second competitor, then the second competitor is "pinned resulting in the first competitor winning the match. If the third image sequentially displayed by the first competitor is any image other than a "submission hold" image, then the second competitor may display any image available as the first image sequentially displayed. Preferably, as the third image sequentially displayed, the second competitor displays a "submission hold" maneuver image, if available.

Figure 14:
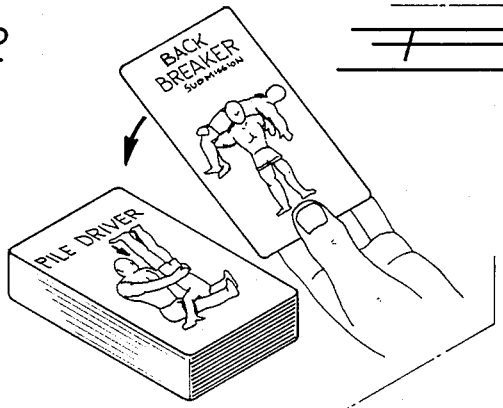

It is contemplated that in the normal display sequence, in each competitor's turn, the first image displayed will be an "escape" maneuver image (FIG. 12), the second image displayed will be a "combat" (basic) maneuver (FIG. 13) and the third image displayed will be a "submission hold" maneuver image (FIG. 14).

The competitors then continue to sequentially draw, in turn, three additional images, so as to have six images available during the turn, and to sequentially choose and display three of the images available, in the manner described above until a "pin" occurs. Throughout subsequent turns, if the third sequentially displayed image is a "submission hold" maneuver image, then the first sequentially displayed image by the other competitor must be an "escape" maneuver image. If not available or displayed, the said other competitor is "pinned", resulting in the said other competitor losing the match.

In the above fashion, it can be seen that the game of the present invention realistically proceeds by, if available, sequential "escape", "combat" (basic), and "submission hold" maneuvers. Also, as in a "real-life" wrestling match, if one competitor manages to place the other competitor in a "submission hold", then the other competitor must first sequentially execute an "escape" maneuver in order to avoid being "pinned" which would result in the said other competitor losing the match.

Obviously many modifications may be made without departing from the basic spirit of the present invention. Accordingly, it will be appreciated by those skilled in the art that within the scope of the appended claims, the invention may be practiced other than has been specifically described herein.

What is claimed is:

1. An apparatus for playing a competitive game for two or more competitors that simulates a competitive wrestling match, said apparatus comprised of:

a plurality of images including a first portion of the images comprising a plurality of wrestling "combat" maneuvers, a second portion of the images comprising a plurality of wrestling "submission hold" maneuvers, and a third portion of the images comprising a plurality of wrestling "escape" maneuvers, the images being devoid of any numerical point value for scoring purposes; and means for distributing the images to the competitors and sequentially displaying the images in a chosen sequence such that display by one competitor of a "combat" image immediately followed by display of a "submission" image signifies said competitor to be the winner unless the other competitor displays an "escape" image, whereby the wrestling match is simulated.

2. The apparatus of claim 1, wherein the ratio of images provided in the first, second and third portions is substantially 7:9:11.

3. The apparatus of claim 1, wherein fifty-four images are provided, the first portion including fourteen of said images, the second portion including eighteen of said images and the third portion including twenty-two of said images.

4. The apparatus of claim 1, wherein the means for sequentially displaying the images in a chosen sequence are playing cards.

5. The apparatus of claim 4, wherein each of the respective playing cards is provided having a "shadow" effect.

6. An apparatus for playing a competitive game that simulates a competitive wrestling match, said apparatus comprised of:

a plurality of images including a first portion of the images representing wrestling "escape" maneuvers, a second portion of the images representing wrestling "submission hold" maneuvers, and a third portion of the images representing other wrestling "combat" maneuvers;

means for sequentially displaying the images in a chosen sequence, whereby the wrestling match is simulated;

wherein the means for sequentially displaying the images in a chosen sequence are playing cards;

wherein each of the respective playing cards is provided having a "shadow" effect; and wherein each of the respective playing cards is laminated with at least two respective sheets, each respective sheet having a portion of the image thereon, the portion of the image in each respective sheet being staggered relative to the other respective sheet, whereby the "shadow" effect is provided when the playing card is tilted.

7. An apparatus for playing a competitive game for two or more competitors that simulates a competitive wrestling match, said apparatus comprised of:

a plurality of images including a first portion of the images coprising a plurality of wrestling "combat" maneuvers, a second portion of the images comprising a plurality of wrestling "submission hold" maneuvers, and a third portion of the images comprising a plurality of wrestling "escape" maneuvers being devoid of any numerical point value for scoring purposes; and a plurality of playing cards, each of said cards having a respective image positioned thereon for sequentially displaying the images in a chosen sequence such that display by one competitor of a "combat" image immediately followed by display of a "submission" image signifies said competitor to be the winner unless the other competitor displays an "escape" image, whereby the wrestling match is simulated.

8. An apparatus for playing a competitive game that simulates a competitive wrestling match, said apparatus comprised of:

a plurality of images including a first portion of the images representing wrestling "escape" maneuvers, a second portion of the images representing wrestling "submission hold" maneuvers, and a third portion of the images representing other wrestling "combat" maneuvers;

a plurality of playing cards, each of said cards having a respective image positioned thereon for sequentially displaying the images in a chosen sequence, whereby the wrestling match is simulated; and wherein each of the respective playing cards is laminated with at least two respective sheets, each respective sheet having a portion of the image thereon, the portion of the image in each respective sheet being staggered relative to the other respective sheet, whereby a "shadow" effect is provided when the playing card is tilted.

9. An apparatus for playing a competitive game that simulates a competitive wrestling match, said apparatus comprised of:

a plurality of images including a first portion of the images representing wrestling "escape" maneuvers, a second portion of the images representing wrestling "submission hold" maneuvers, and a third portion of the images representing other wrestling "combat" maneuvers;

a plurality of playing cards, each of said cards having a respective image positioned thereon for sequentially displaying the images in a chosen sequence, whereby the wrestling match is simulated;

wherein each of the respective playing cards is laminated with at least two respective sheets, each respective sheet having a portion of the image thereon, the portion of the image in each respective sheet being staggered relative to the other respective sheet, whereby a "shadow" effect is provided when the playing card is tilted; and wherein fifty-four images are provided, the first portion including fourteen of said images, the second portion including eighteen of said images and the third portion including twenty-two of said images.

* * * * *